US005087391A

United States Patent [19]

Brown

[11] Patent Number: 5,087,391

[45] Date of Patent: Feb. 11, 1992

[54] SERVICING MECHANISM FOR ROTATIONAL PIPING ARRAY

[75] Inventor: David P. Brown, Salt Lake City, Utah

[73] Assignee: Baker Hughes Incorporated, Houston, Tex.

[21] Appl. No.: 535,212

[22] Filed: Jun. 8, 1990

[51] Int. Cl.[5] ..... B01F 3/04

[52] U.S. Cl. ..... 261/122; 210/221.2; 261/124; 261/DIG. 47; 280/47.315

[58] Field of Search ..... 261/122, 124, DIG. 47; 280/47.315, 47.33; 301/111; 210/195.1, 220, 221.2

[56] References Cited

U.S. PATENT DOCUMENTS

| | | | |
|---|---|---|---|
| 2,527,097 | 10/1950 | Katow | 261/DIG. 47 |
| 2,938,734 | 5/1960 | Guimond | 280/47.315 X |
| 3,116,021 | 12/1963 | Born | 261/DIG. 47 |
| 3,525,436 | 8/1970 | Reckers | 261/124 X |
| 3,606,371 | 9/1971 | Rousseau et al. | 280/47.315 X |
| 3,864,441 | 2/1975 | Suzuki | 261/DIG. 47 |
| 3,989,627 | 11/1976 | Crandall | 210/220 |
| 4,048,267 | 9/1977 | Walker et al. | 261/DIG. 47 |

*Primary Examiner*—Richard L. Chiesa
*Attorney, Agent, or Firm*—Skjerven, Morrill, MacPherson, Franklin & Friel

[57] ABSTRACT

A portable wheeled hand truck mounts a rotary actuator, powered by a hand or motor-operated pump also contained on the truck, for lifting and rotating a diffused aeration piping array from a liquid/slurry treatment tank into a working and servicing position adjacent to the tank, such as a walkway. The wheeled truck is hand maneuvered so that the powered end of the actuator is in alignment with a connection arm extending from a pivotable pipe which is part of the array. A multi-positionable handle is included on the hand truck which, in an essentially horizontal position, is temporarily fixed to a tank walkway surface to support the reaction forces incident to lifting and rotating the heavy mass of the piping array. When not so fixed, the handle may be moved to an essentially vertical position for storage and to an intermediate position to maneuver the truck into alignment with the piping array connector arm.

10 Claims, 5 Drawing Sheets

SERVICING MECHANISM FOR ROTATIONAL PIPING ARRAY

This invention pertains to a portable servicing mechanism for lifting and rotating a piping array from a tank or other location to a working and servicing position. More particularly, the invention is directed to a portable wheeled hand truck mounting a rotary actuator, which truck is maneuvered, fixed in place and then operated to lift and rotate a diffused aeration piping array from a treatment tank.

BACKGROUND OF THE INVENTION

Diffused aeration systems are employed for injecting air or other gases such as oxygen into bodies of water; waste water and other liquids. These systems generally include a series of piping components with fittings and swivel joints, connected to a header system to which is connected a series of air diffusers, such as those of the membrane type shown in U.S. Pat. Nos. 3,525,436, 4,631,134 and 4,764,314. In service the header system, diffusers and part of the piping are submerged in the water, waste water or process liquid. Pressurized air or other gas is introduced in such a manner that biological or other processes are optimally satisfied. U.S. Pat. Nos. 4,294,696 and 3,396,950 show typical aeration systems. Heretofore, when the system is to be maintained the liquid has been withdrawn from the tank or vessel and work done on the system while the system is disposed in the tank. This has several drawbacks due to the inconvenience and hazard of working in the tank and the necessity of shutting down the liquid flow. Further the lower part of aeration system may well be covered with sludge which must be washed off before commencing repairs, rework or replacement of diffusers. Because of these problems others have practiced the use of various methods of lifting the aeration piping, including the diffusers, from the tank utilizing complex booms such as jib cranes or linear actuator-type hydraulic lifting mechanisms.

Such lifting equipments are normally relatively complex, expensive, large in size and difficult or impossible to position, especially on a walkway or small service platform extending at the edge or across a tank. A need has thus existed for a simple, maneuverable, small and easily maintained and operated device for servicing and maintaining or stowing a diffused aeration piping array and other piping arrays. Such a device would function to lift the operational part of the piping array from the tank to an out-of-the liquid position where personnel may easily access the array for required maintenance and servicing. A typical diffused aeration piping array utilizes 12 cm diameter drop pipes made of steel with a typical array of 20 diffusers. The piping may extend downwardly from about 3 M (meters) to about 6 M and have a total weight of about 200 kilograms which must be lifted. The lifting devices in the prior art have thus been of heavy duty, of large size and weight to take up the lift reaction forces.

SUMMARY OF THE INVENTION

The invention is directed to a self-contained, relatively small, lightweight hand truck device which is hand maneuverable on a small or narrow walkway surface or work platform in areas which would be inaccessible for prior art devices. Due to the simple and compact construction the mechanism is relatively inexpensive and may be hand transported by rolling to a position on the walkway to lift and lower in turn and to service an unlimited number of individual piping arrays, including headers and diffusers, employed in a single or in multiple tanks.

The servicing mechanism is a small hand truck of relatively small size and weight which can be handled by one or two persons. A support frame with wheels thereunder and a handle movable as required into an essentially horizontal "lift" position, to an intermediate "transport" position and to an essentially vertical mechanism "stowed" position are employed. In order to support the reaction forces incident to the lifting of the heavy weight of the piping array, the handle and frame, in the operational position, are temporarily fixed to the walkway structure. This is typically done by the use of a walkway embedded threaded insert or anchor alongside each array and a bolt and washer or hook connecting the insert or anchor to a securing bracket on the handle. An hydraulic rotary actuator and a hand or motor-operated pump are mounted on the frame. A swivel joint on the upper rotatable end of the piping array has connection structure such as a connector bracket extending therefrom. The hand truck, more particularly the powered rotary end of the rotary actuator, is positioned and aligned with the swivel joint bracket or other connector, is connected to the arm by a quick-disconnect fastener, and the actuator rotated by operation of the pump to lift and rotate the piping array into an accessible position for maintenance. A pair of crank-adjustable support feet extend from the frame to aid in the alignment. When the piping, header, diffuser array is lifted and rotated, typically approximately 175°, the header and diffusers are in a final position immediately next to the hand truck where they can be easily accessed for maintenance. The service mechanism is also employed to re-rotate the array from the servicing position back into the tank for operational use.

DETAILED DESCRIPTION OF THE PREFERRED EMBODIMENT

Figure 1:
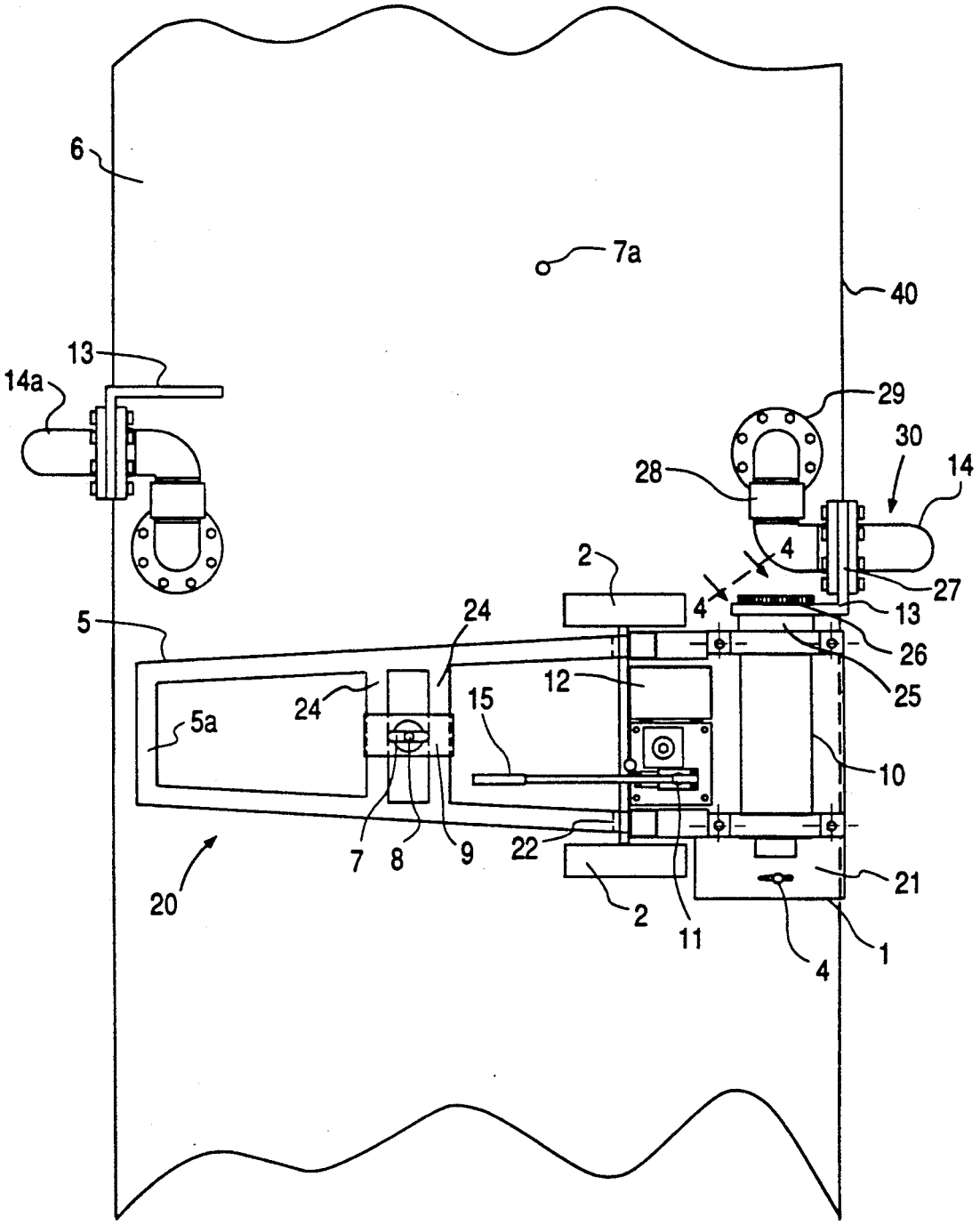
FIG. 1 is a top view of walkway, pivotable piping arrays and the servicing mechanism of the invention.
Figure 2:
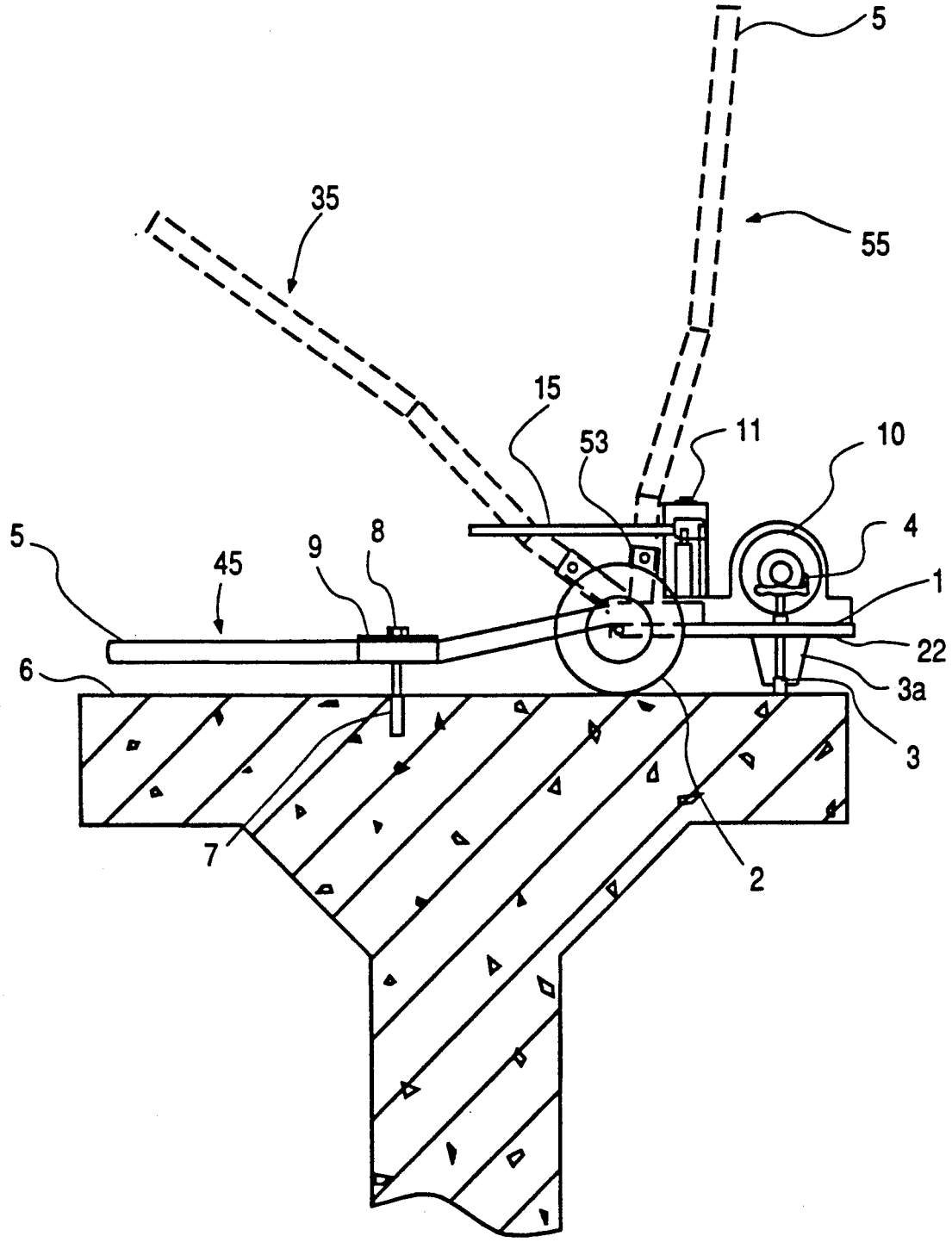
FIG. 2 is a side view of the servicing mechanism as positioned in a lifting operational mode.
Figure 3:
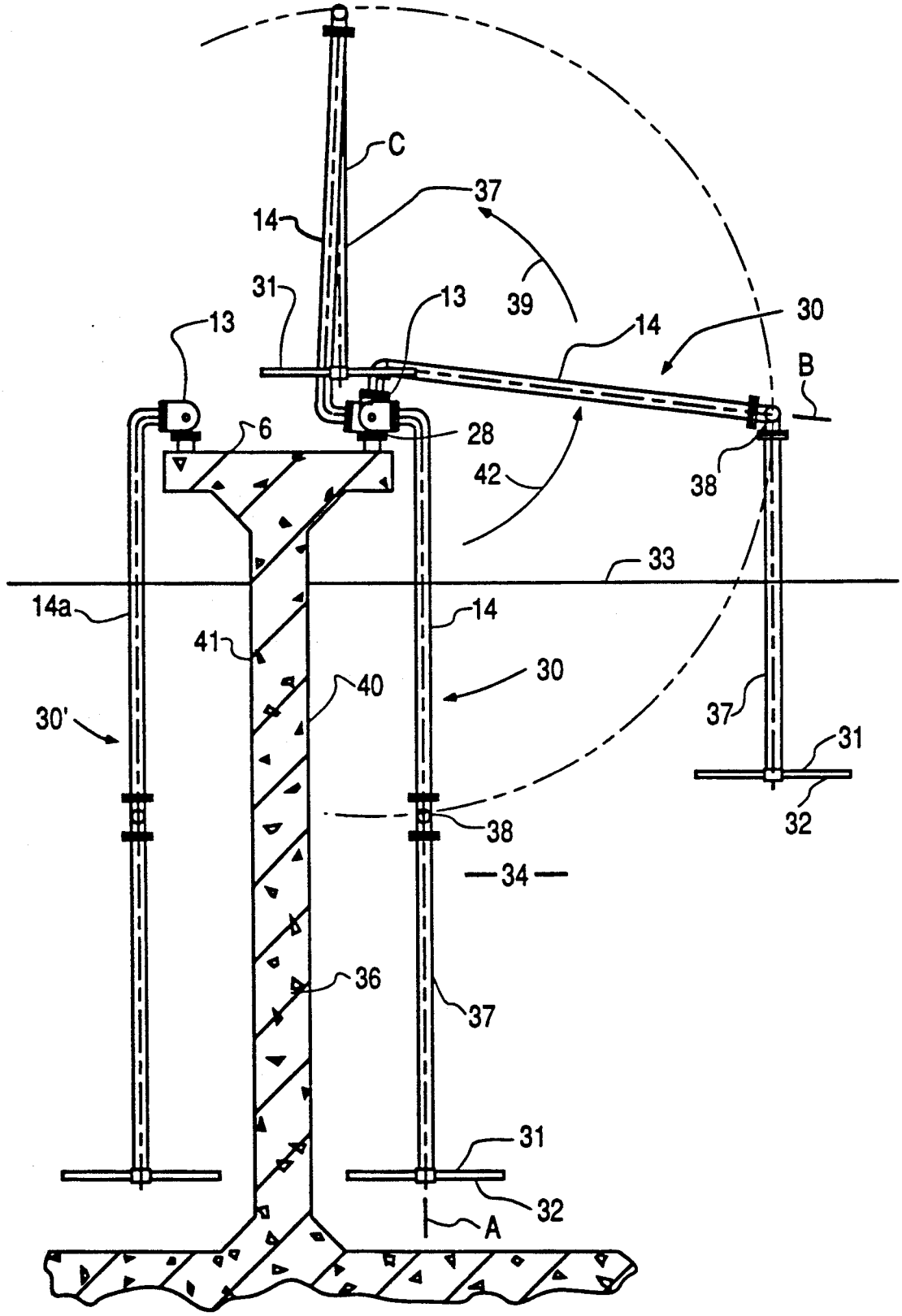
FIG. 3 is a side view of the piping array showing the lifting motion of the piping array with respect to a tank walkway.
Figure 5:
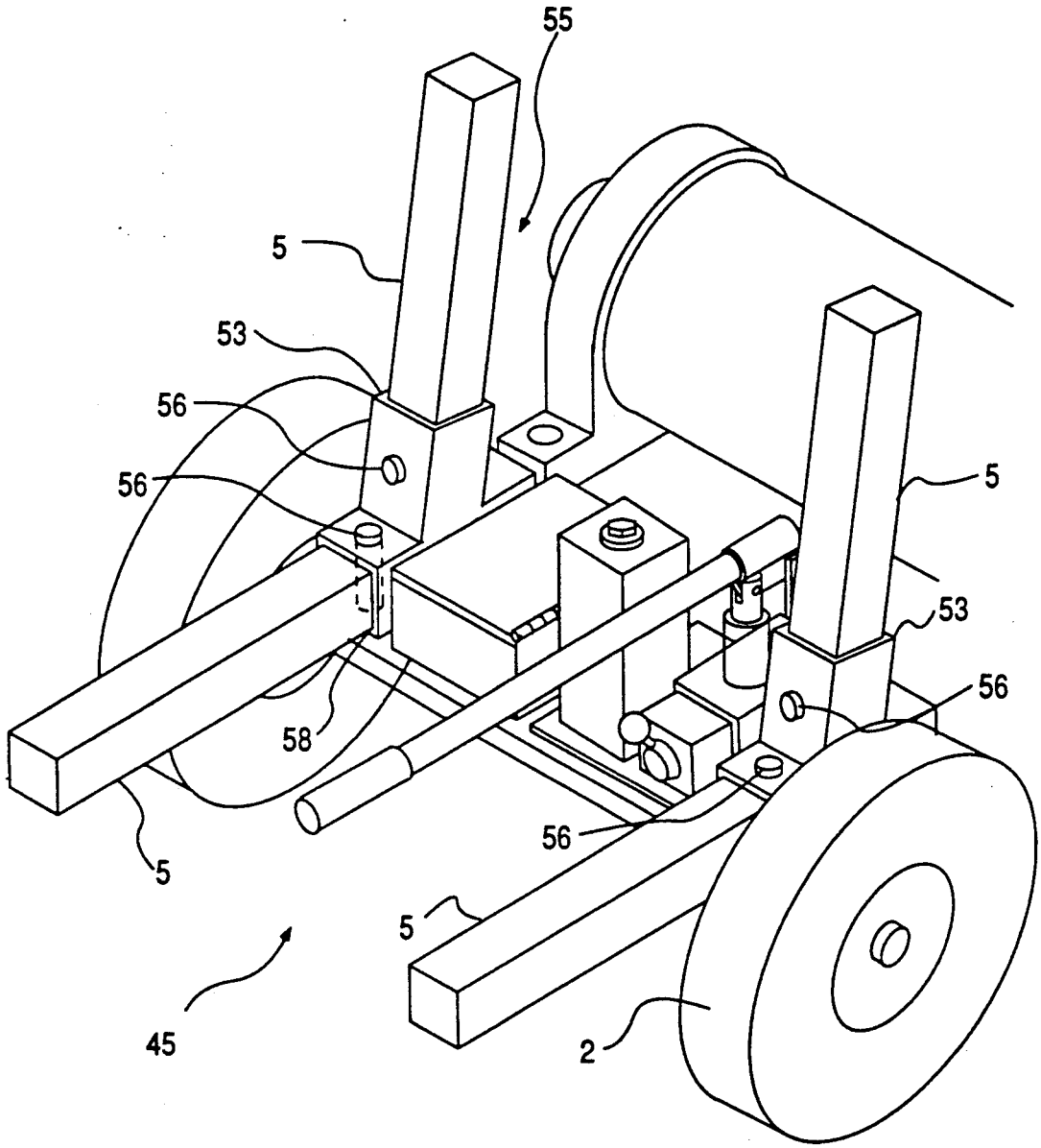
FIG. 5 is an isometric view of the handle adjustment mechanism.

The servicing mechanism 20 of the invention as seen in FIG. 1 may be termed to be a hand truck and includes a support frame 1 in the form of a fixed component-mounting platform 21 extending across a pair of side bars 22 and a pair of wheels 2 axle-mounted across the support frame. Connected to the frame 1 is a movable handle assembly 5 that is used, as seen in FIG. 2, in an angular position 35 while maneuvering the hand truck, in an essentially horizontal position 45 to secure the hand truck to a walkway surface 6 extending alongside or across a liquid-holding tank 40, and in an essentially vertical position 55 to stow the handle. A movable securing bracket 9 extends across a pair of handle crossbars 24 between the distal end 5a of the handle and the connection of the handle to the frame (FIG. 5). The bracket 9 is temporarily connected in an operational array shifting mode to an embedded threaded insert 7, insert 7a or other holding means such as an embedded hook bar or other embedment in the walkway surface 6. A bol. and washer combination 8 threadably extends into the insert 7 from the bracket 9 and is designed to take the reaction forces incident to the described array lifting operations. If an embedded bar is utilized, a threaded hook member can be taken up by bracket 9 to connect the handle to the walkway. The inserts 7, 7a will normally be staggered so that they are in proper position to service, respectively, first the first array 30 including pivoted top pipe 14 extending from one side of the walkway surface and then another array 30' including pivoted top pipe 14a extending from the other edge of the walkway surface as seen in FIG. 3.

A hydraulic or electrically operated rotary actuator 10 is mounted on the platform 21 with the powered end 25 of the actuator extending outwardly from platform 21. A hand or motor-actuated pump 11 is also mounted on platform 21 to rotate the actuator. The rotary actuator may be a commercially available actuator such as the Model 60K actuator available from Helac of Enumclaw, Wash. Likewise, the pump may be a hand pump such as a Model HV 100-6 pump available from TR Engineering of Campbell, Calif. or a similarly functioning motor-operated pump.

A quick-disconnect fastener 26 of the socket head capscrew type is provided on the actuator powered end 25 into which an L-shaped connector bracket 13 of a pipe bracket 27 fits. Bracket 27 is connected to the pivoted top pipe 14 of a piping array 30. Pipe 14 pivots about rotary joint 28 which is connected by suitable fittings 29 to an air or gas source (not shown).

A removable handle 15 may be employed to operate pump 11. An accessory and tool storage box 12 may also be mounted on platform 21.

FIG. 2 shows more clearly the three positions of handle 5, namely the substantially horizontal lift operating position 45, the angular transport position 35 and an essentially vertical storage position 55. FIG. 2 also shows the threaded insert 7 in the walkway surface and a hand-crank 4 for leveling a pair of support feet 3 extending from under the frame and at an end of the frame opposite the handle. A housing 3a surrounds each support foot. The support feet are aligned with the longitudinal axis of the actuator. The wheels 2 are intermediate of the handle and the support feet. Alignment of the feet accommodates any level variations on the walkway surface 6 and aids in aligning the rotary actuator powered end 25 to the pipe bracket connector bracket 13.

FIG. 3 illustrates the swing movement of array 30 from a vertical position A where the diffuser header 31 with attached diffusers (not shown) located at position 32 are submerged horizontally in the liquid 34 contained in tank 40 below upper liquid level 33. Arrow 42 shows the first increment of rotation of the array 30 to position B with the pipe 14 rotating about swivel joint 28. At the same time, pipe 37 and header 31 stay in the same vertical and horizontal positions, respectively, while moving laterally and upward due to the presence of rotary joint 38. In a concluding increment of rotation, as shown by arrow 39, both of pipes 14 and 37 are essentially vertical in position C with the header 31 still remaining horizontal but now in a service position above walkway surface 6. FIG. 3 also illustrates arrays 30, 30' positioned in each of tanks 40 and 41 typically separated by a concrete wall 36 and the walkway surface 6.

Figure 4:
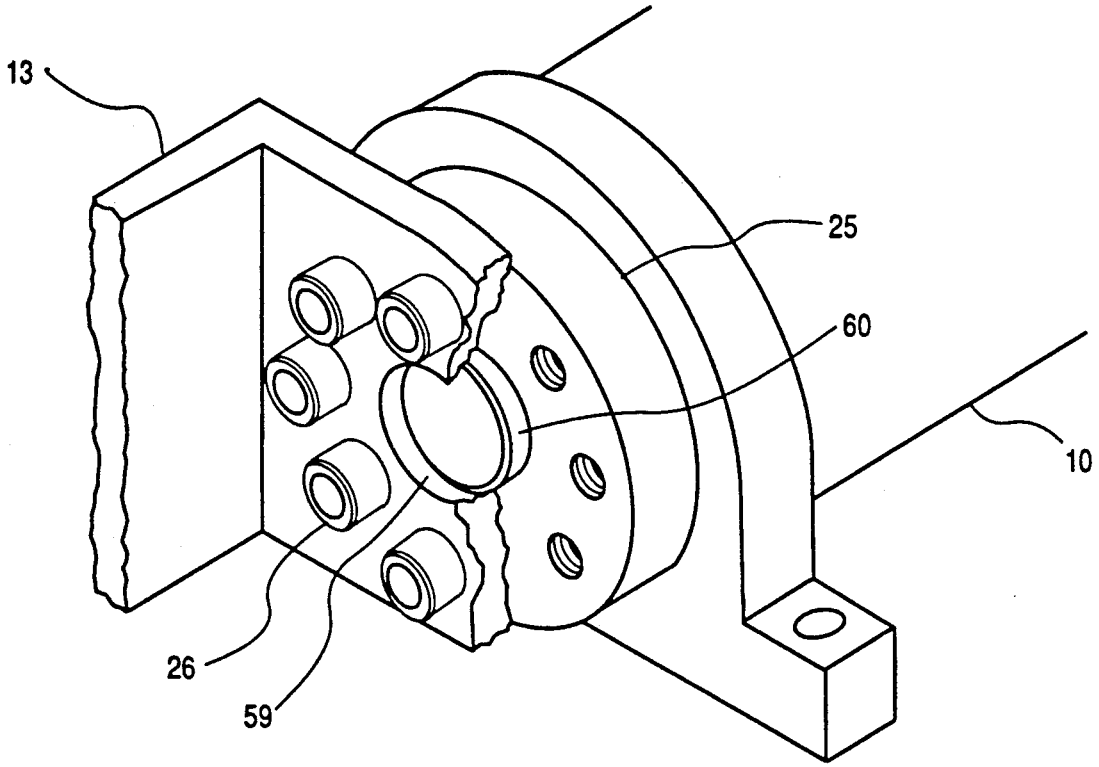
FIG. 4 is an isometric view of the rotary actuator end, quick disconnect fastener and piping connection bracket taken from one side of line 4—4 in FIG. 1.

FIG. 4 illustrates an isometric view of connector arm 13 which has a piloted configuration with a pilot hole 59 apertured to connect to a pivot 60 on the powered end 25 of the actuator. Arm 13 is connected to the powered end of the rotary actuator by fasteners 26, such as a sockethead cap screws. It essentially comprises a self-aligning bolted and piloted connection which functions to transmit the rotational motion of the actuator to the piping array.

FIG. 5 illustrates the handle adjustment mechanism. In stowed position 55, the handle 5 is positioned in vertical opening in support base 53 and is secured with locking pins 56. In lift operating position 45 the handle 5 is positioned in horizontal openings 58 in support base 53 and is secured with locking pins 56. The handle 5 may be angularly lowered from the locked vertical position 55 to transport the servicing mechanism 20 by wheels 2 along the walkway surface 6.

The above description of the preferred embodiment of this invention is intended to be illustrative and not limiting. Other embodiments of this invention will be obvious to those skilled in the art in view of the above disclosure.

I claim:

1. A portable servicing mechanism for lifting and rotating a piping array having a first piping end in a pivot connection juxtaposed to a walkway surface, a second piping end operationally positioned below said surface and at least one intermediate rotatable piping joint therebetween, said mechanism comprising:

a support frame having at least two wheels for moving said mechanism along a walkway surface;

handle means connected to said support frame for manual maneuvering said support frame, said handle means including means for releasibly securing said support frame to the walkway surface;

a rotary actuator mounted to said support frame and being connectable in operational use to said first piping end;

power means mounted on said support frame for rotatably actuating said actuator to rotate said first piping end such that said piping array is rotated to a servicing position above the walkway surface adjacent to said support frame;

wherein said support frame includes a pair of said wheels at one frame end and at least one support foot spaced from said wheels, said at least one support foot being in contact with the walkway surface when said handle means is secured to the walkway surface and wherein said handle means is pivotable with respect to said support frame to an angular position with respect to said support frame to allow said mechanism to be wheeled from one position on the walkway surface to another when said handle means is unsecured from the walkway surface; and wherein said means for releasibly securing said support frame comprises a securing bracket on said handle means, an embedded insert in the walkway surface and means for temporarily securing said handle means and securing bracket to the embedded insert.

2. The servicing mechanism of claim 1 further including a leveling crank connected to said support frame adjacent said support feet for adjusting the height of said support feet.

3. The servicing mechanism of claim 1 wherein said securing bracket is positioned on said handle means between a connection of one end of the handle means to said support frame and a distal end of the handle means.

4. A servicing hand truck for rotatably raising and lowering a piping array extending from a walkway surface including a frame;

a handle portion extending from a first end of said frame for hand maneuvering said frame;

a pair of wheels mounted on said frame;

a rotary actuator mounted on said frame and being temporarily connectable to said piping array;

means on said frame for actuating said rotary actuator;

means extending downwardly from said handle portion for temporarily fixedly connecting said handle portion and said frame to the walkway surface, while said rotary actuator is rotatably raising and lowering said piping array and while said piping array is being serviced; and wherein said handle portion is pivotally movable into an essentially horizontal position for connection to the walkway surface; to an essentially vertical position for stowage and to an angular position intermediate of said essentially horizontal and vertical positions for maneuvering said frame and said rotary actuator into alignment for connection to said piping array.

5. The hand truck of claim 4 wherein said rotary actuator is a hydraulic actuator and said means for actuating is a hydraulic pump.

6. The hand truck of claim 5 wherein said pump is hand-operated.

7. The hand truck of claim 4 including a pair of height adjustable support feet connected to and extending from an underside of said frame under said rotary actuator.

8. In combination, a diffused aeration piping system having a bottom diffuser section, a top pipe section pivoted to a walkway surface and a connector portion fixedly extending from said top pipe section; and a servicing mechanism transportable on said walkway surface for connection to said connector portion; said servicing mechanism comprising:

support frame having a pair of wheels adjacent a support frame end for moving said mechanism along said walkway surface;

handle means connected to said support frame for manual maneuvering said support frame, said handle means including means for releasibly securing said handle means and said support frame to said walkway surface;

a rotary actuator mounted to said support frame and being connectable adjacent to said connector portion;

means mounted on said support frame for rotatably actuating said rotary actuator to rotate said first piping end such that said piping array is rotated to a servicing position above said walkway surface adjacent to said support frame; and wherein said support frame includes a pair of support feet spaced from said wheels, said support feet being in contact with said walkway surface when said handle means is secured to said walkway surface and wherein said handle means is pivotable with respect to said support frame to an angular position with respect to said support frame to allow said mechanism to be wheeled from one position on said walkway surface to another when said handle means is unsecured from said walkway surface.

9. The combination of claim 8 wherein said means for releasibly securing said handle means includes a securing bracket on said handle means, holding means in said walkway surface and a fastener temporarily securing said securing bracket to said holding means.

10. The combination of claim 9 wherein said securing bracket is positioned on said handle means between a connection of one end of the handle means to said support frame and a frame pick-up opposite end of the handle means.

* * * * *